US005880414A

United States Patent [19]

Jaminet et al.

[11] Patent Number: 5,880,414

[45] Date of Patent: Mar. 9, 1999

[54] ELEVATOR DOOR BRAKE, BRAKE, LOCK, AND HOLD-OPEN

[75] Inventors: Jerome F. Jaminet, Windsor; Thomas M. Kowalczyk, Farmington; Frank Guliuzza, Jr., Wallingford, all of Conn.; Edward E. Ahigian, Chicago, Ill.; Richard E. Kulak, Bristol, Conn.; Thomas M. McHugh, Farmington, Conn.; Thomas He, Unionville, Conn.; Richard E. Peruggi, Glastonbury, Conn.; David W. Barrett, East Hartland, Conn.

[73] Assignee: Otis Elevator Company, Farmington, Conn.

[21] Appl. No.: 1,728

[22] Filed: Dec. 31, 1997

[51] Int. Cl.[6] ..... B66B 13/14; B66B 13/02

[52] U.S. Cl. ..... 187/316; 187/331

[58] Field of Search ..... 187/316, 317, 187/331, 313; 49/90.1, 116, 118

[56] References Cited

U.S. PATENT DOCUMENTS

| | | | |
|---|---|---|---|
| 4,188,552 | 2/1980 | Brimer | 310/13 |
| 4,501,090 | 2/1985 | Youshida et al. | 49/264 |
| 4,529,065 | 7/1985 | Kraft | 187/314 |
| 5,671,829 | 9/1997 | Rivera | 188/171 |

*Primary Examiner*—Robert E. Nappi

[57] ABSTRACT

When an elevator is running, the car door 27 is locked in the closed position by a brake shoe 12 which engages the edge of the door hanger 24 in response to a push-type solenoid 19 overcoming the force of a spring. When the door is not closed, a friction brake pad 11 contacts the door hanger surface to hold the door open for passenger boarding or to stop the door in case of failure of door operator power while the door is in motion.

2 Claims, 2 Drawing Sheets

ELEVATOR DOOR BRAKE, BRAKE, LOCK, AND HOLD-OPEN

TECHNICAL FIELD

This invention relates to a device for locking elevator doors in the closed position when the elevator is moving, slowing the doors to a stop if power is lost during door motion, and holding the doors open at a landing.

BACKGROUND ART

Due to the intrinsic design of an elevator door operator powered by a linear electric motor, there is no mechanical coupling or link between the primary and secondary of the motor. With power off, the motor cannot provide a braking force, a hold-closed force, or a hold-open force on the door. With power applied to the linear electric motor, the motor force available is insufficient to provide a hold-closed force (also called "evacuation deterrent force") required by safety codes, which is typically required to be 450 Newtons or more. Furthermore, providing power to the linear electric motor when the door is not moving is not desirable due to heat generated as a consequence of the relative inefficiency of a linear electric motor with a static secondary.

DISCLOSURE OF INVENTION

Objects of the invention include provision of code-required braking, hold-closed and hold-open forces for elevator doors, independently of the linear electric motor powered door operator.

According to the present invention, a friction brake pad is forced against the surface of an elevator door hanger by a push-type solenoid, the friction brake shoe being urged away from the door hanger when braking action is not desired, by means of a spring. In one embodiment, current is applied to the push-type solenoid only when braking action is desired; in another embodiment, current is supplied to the push-type solenoid whenever there is elevator door power, and the resulting force is neutralized by force generated by current supplied to the linear electric motor, whenever the doors are to be moved. Momentary braking, to stop the door when power is lost during door motion, is achieved by momentarily operating the push-type solenoid.

The invention provides a simple way to achieve required door holding or braking, without using force of a door operator.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
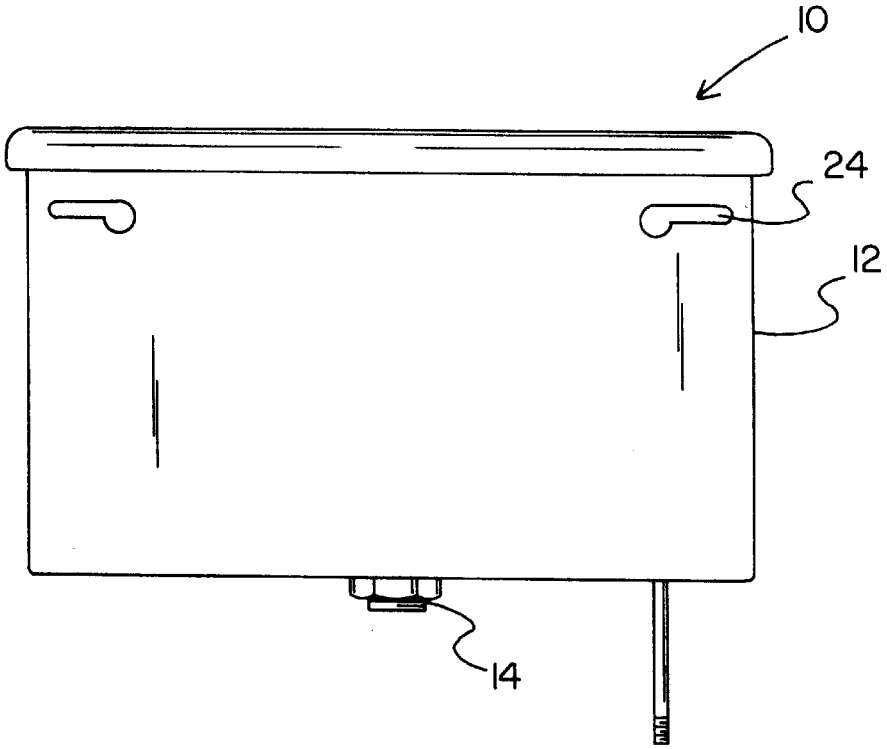
FIG. 1 is a fragmentary top plan view of an elevator door brake of the invention, mounted on an elevator and acting against a door hanger.

Referring to FIG. 1, a friction brake pad 11 is adhered to a brake shoe 12 that is fastened to the end of a steel spring

14 by any suitable means such as a bolt 16. The other end of the spring 14 is fastened to an elevator car, such as an elevator door lintel 18. A push-type solenoid 19 is fastened to the same structure, such as by bolts 20. The solenoid 19 has an armature 22 that will press the brake shoe and therefore the friction brake pad 11 against a door hanger 24, which supports the elevator car door. When the solenoid is energized as shown in FIG. 1, braking action is provided between the pad 11 and the door hanger 24. When the solenoid 19 is not energized, the spring 14 will cause the brake shoe and therefore the brake pad 11 to be retracted away from the door hanger 24.

Figure 2:
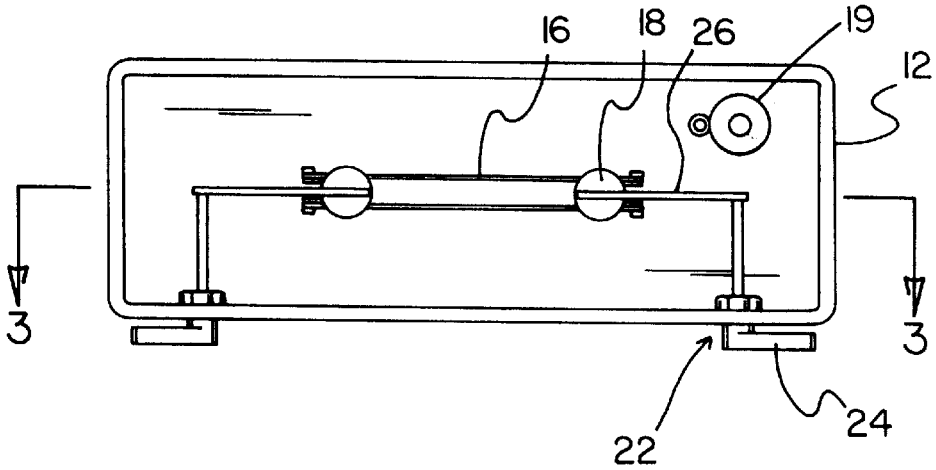
FIG. 2 is a partial, partially broken away, perspective view of an elevator door operated by a linear electric motor, utilizing the brake of FIG. 1.

As seen in FIG. 1, the armature 22 is not fully extended, its position being limited by the door hanger 24. When the armature 22 is fully extended, with the elevator door fully closed, an edge 25 of the brake shoe 12 will engage the edge of the door hanger 24, as is illustrated in FIG. 2. Therein, the elevator door 27 is shown attached to the door hanger 24, which has rollers 28 that allow the door hanger 24 to travel along a rail 30 shown broken away in FIG. 2. The door hanger 24 also comprises a secondary of a linear electric motor, the primary 32 of which is fastened to suitable elevator car structure, such as the lintil 18. The outline of the door opening is illustrated by the dotted lines 33. Thus, when the door is fully closed and current is provided to energize the solenoid 19, the armature 22 will push the brake shoe 12 to the position shown in FIG. 2 where the edge 25 overlaps the end of the door hanger 24, whereby to absolutely lock the elevator door in the closed position. This satisfies one of the requirements of the safety code.

Figure 3:
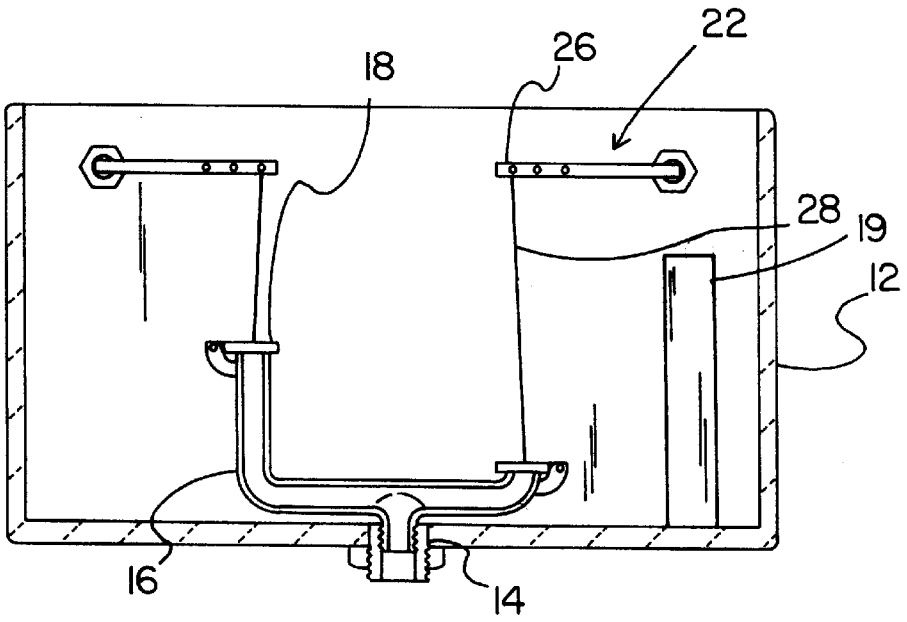
FIG. 3 is a schematic diagram of a coil for operating a push-type solenoid plunger, in a first embodiment of the invention.

Referring to FIG. 3, a simplest embodiment of the present invention applies a DC voltage across a coil 35 of the armature 19 whenever braking action is desired. This operation is illustrated in Table One. As seen in Table One, in the first column, when the elevator is running vertically in the hoistway, the door is closed and brake action is required so as to provide at least 450 Newtons of force on the door to keep it closed. At this time, the linear electric door operating motor 32 is not provided with any current. But the voltage is applied to the solenoid 19 causing it to move the armature 22 into the position shown in FIG. 2, holding the door fully closed. On the other hand, in the second column, when the car is at a landing and the elevator door has been fully opened to allow passengers to enter and leave the car, braking action is required to keep the door open. At that time, there is no current supplied to the linear electric motor 32. However, current is supplied to the solenoid 19 so that it will provide on the order of 200 Newtons of force (although only a fraction of that is actually required) to hold the door open, as seen in FIG. 1. When the door is being opened or closed, as shown in column 3 of Table One, no braking action is required, there is current provided to the linear electric motor 32 but there is no current provided to the solenoid 19 and the spring 14 (FIG. 1) pulls the friction brake pad 11 away from the door hanger 24 so that there is no force on the door hanger. If power to the door operator is lost while the door is being closed, then, as shown in the fourth column of Table One, momentary braking action is required in order to stop the door, after which the door should be fully unlocked so that people can leave the car. In this case, while motor current is initially applied to the LIM, that current ends at the time of power loss. At that point in time, current is to be supplied to the solenoid 19 so as to cause the friction brake pad 11 to provide braking action

TABLE ONE

| | Elevator Running | Door Open | Operate Door | Lose Door Power | No Door Power |
|---|---|---|---|---|---|
| Action | Brake | Brake | No Brake | Momentary Brake | No Brake |
| I motor | Off | Off | On | On→Off→Off | Off |
| I sol. | On | On | Off | Off→On→Off | Off |
| Force | >450 N | ~200 N | 0 | O→200 N→0 | 0 |

TABLE TWO

| | Elevator Running | Door Open | Operate Door | Lose Door Power | No Door Power |
|---|---|---|---|---|---|
| Action | Brake | Brake | No Brake | Momentary Brake | No Brake |
| I motor | Off | Off | On | On→Off→Off | Off |
| I sol. | On | On | On | On→On→Off | Off |
| Force | >450 N | ~200 N | 0 | O→200 N→0 | 0 |

the door hanger 24, as shown in FIG. 1. This will cause the initial lack of force when the door is being moved by the door operator to be changed to about 200 Newtons of force for several seconds, after which the force again reduces to zero. If the solenoid current is provided by the same source of door power, then an alternative source of momentary braking energy must be provided (such as car emergency lighting power), in an obvious fashion. The last column of Table One illustrates the case where there is no door power at all (such as after losing door power). No braking action is required. There is no current to the motor or the solenoid and there is no force on the door hanger.

Figure 4:
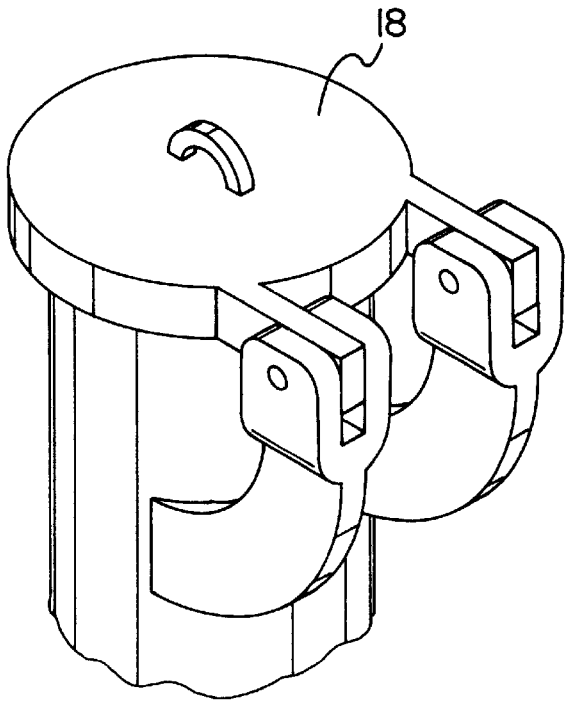
FIG. 4 is a schematic diagram illustrating the use of linear electric motor currents to counteract brake solenoid currents, in a second embodiment of the invention.
Figure 1:
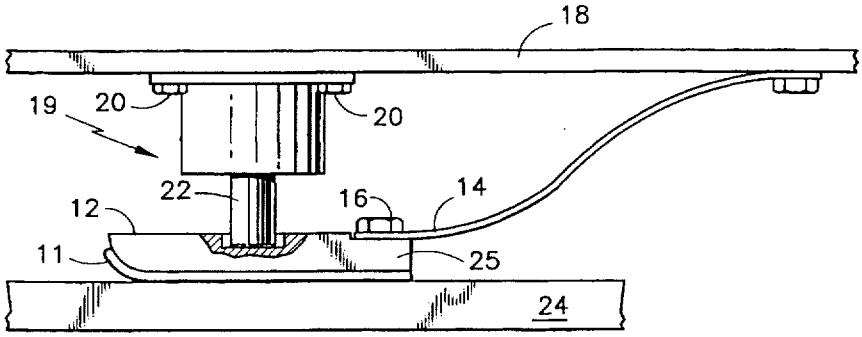
Figure 3:
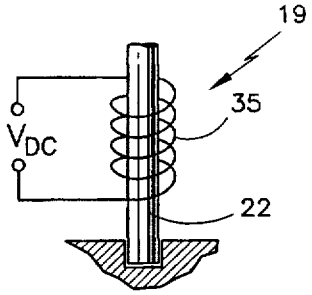
Figure 4:
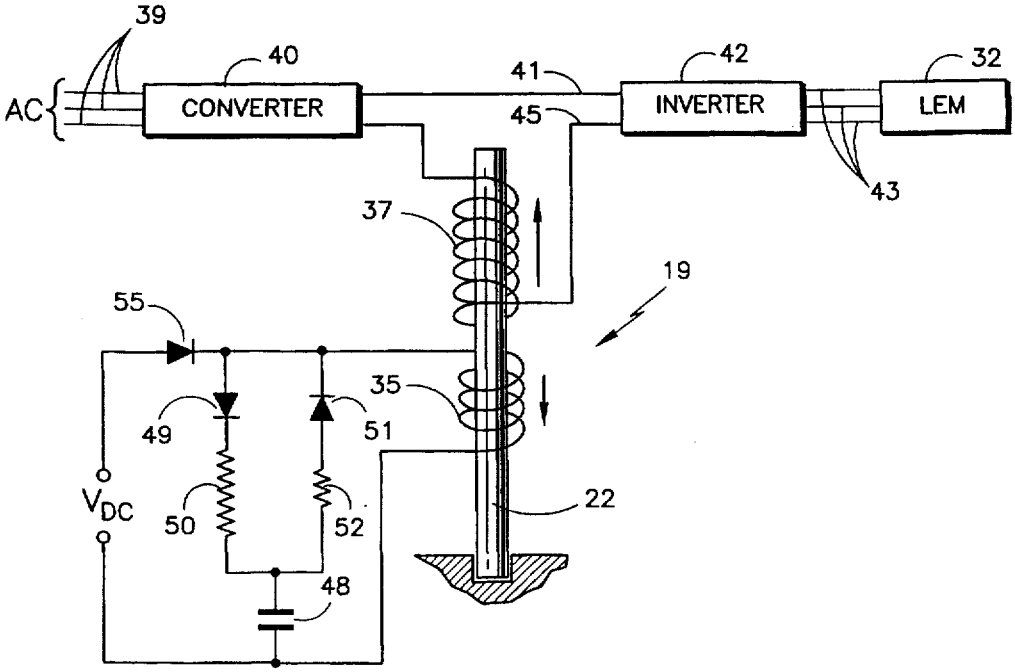
Figure 2:
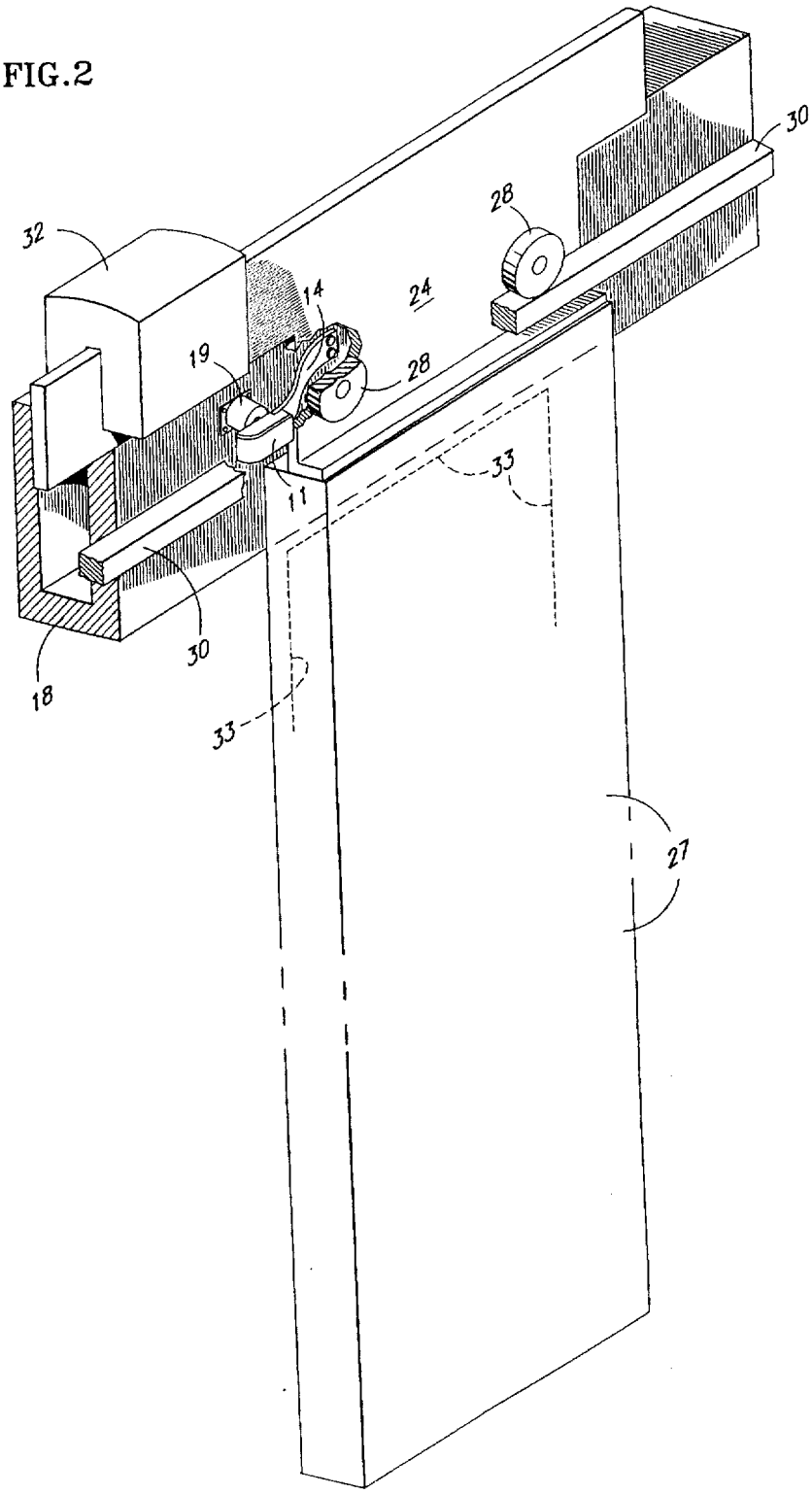

A second embodiment of the invention is shown in FIG. 4. Therein, in addition to the coil 35, a second coil 37 is energized by door operator motor current. In FIG. 4, power is provided from the AC mains 39 to an AC to DC converter 40 which provides DC current over a link 41 to a DC to AC inverter 42 which provides suitable current over lines 43 to the linear electric motor 32. A return path 45 for the DC motor current is connected to the coil 37, which has sufficient turns such that in response to normal motor current, a disengaging force (illustrated by the upward arrow in FIG. 4), substantially greater than the engaging force provided by the coil 35 (illustrated by the downward arrow in FIG. 4), so that it counteracts the force of the coil 35 and causes the brake to be fully released.

The operation of the second embodiment of FIG. 4 is further illustrated by Table Two. With the elevator running, braking action is the same as in the previous embodiment, there being no motor current, but current is applied to the solenoid, causing the brake shoe 12 to engage the edge of the door hanger 24 as shown in FIG. 2. When the car is at a landing with the door open, the door is held open by braking action by virtue of current through the solenoid, there being no current through the electric motor. When the door is operated, however, no braking action is desired and motor current passing through the coil 37 provides a force to countermand the force of the coil 35, causing the brake to be disengaged. If power is lost while the door is being closed, momentary braking is required. The motor current will cease and remain off; the solenoid current which is initially on will be held on by virtue of a capacitor 48 (FIG. 4) which is slowly charged through a diode 49 and a large resistor 50, and which can quickly maintain current through the coil 35 through a diode 51 and a small resistor 52. The large resistor 50 keeps the capacitor 48 from slowing the action of the coil 35 when it is initially energized. Once the energy in the capacitor 48 has dissipated in the coil 35, there is no further current in the solenoid, so braking action ends. The momentary operation of the coil 35 in the absence of current through the coil 37 provides the braking action necessary to stop the door, once it is no longer being driven by the door operator. A diode 55 prevents the energy of the capacitor from flowing back to the Vdc source, should such source become shorted.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Brake apparatus for an elevator car door, comprising:

an elevator car;

a door hanger for an elevator car door;

a brake shoe resiliently disposed on said car between said car and said hanger, said brake shoe being resiliently urged toward said car and away from said hanger;

a push-type solenoid disposed on said elevator car between said brake shoe and said car, and operable when energized to alternatively either when said elevator door is fully closed, push said brake shoe past the edge of said elevator door so as to lock said elevator door in said fully closed position, or when said elevator door is not fully open, push said pad against the surface of said hanger so as to provide braking action between said pad and said hanger.

2. Braking apparatus according to claim 1 wherein said push-type solenoid has two coils, the first coil being energized at all times when the door operator is energized in a manner to tend to cause said solenoid to push said brake shoe toward or beyond said door hanger, the other coil being supplied with door operator current in a manner to provide a force that counteracts the force provided by said first coil and thereby allow said spring to retract said shoe from said hanger whenever door operator current is flowing.

* * * * *

UNITED STATES PATENT AND TRADEMARK OFFICE

CERTIFICATE OF CORRECTION

PATENT NO. : 5,880,414
DATED : Mar. 9, 1999
INVENTOR (S) : Jaminet et al.

It is certified that error appears in the above-identified patent and that said Letters Patent is hereby corrected as shown below:

The title page, delete the illustrative figures, and substitute therefor the illustrative figures as shown on the attached title page.

Delete sheets 1 and 2, drawings Fig. 1, Fig. 2, Fig. 3 and Fig. 4, and insert the attached sheets 1 and 2.

Signed and Sealed this

Fifth Day of October, 1999

*Attest:*

*Attesting Officer*

Q. TODD DICKINSON

*Acting Commissioner of Patents and Trademarks*

US005880414A

United States Patent [19]

Jaminet et al.

[11] Patent Number: 5,880,414

[45] Date of Patent: Mar. 9, 1999

[54] ELEVATOR DOOR BRAKE, BRAKE, LOCK, AND HOLD-OPEN

[75] Inventors: Jerome F. Jaminet, Windsor; Thomas M. Kowalczyk, Farmington; Frank Guliuzza, Jr., Wallingford, all of Conn.; Edward E. Ahigian, Chicago, Ill.; Richard E. Kulak, Bristol, Conn.; Thomas M. McHugh, Farmington, Conn.; Thomas He, Unionville, Conn.; Richard E. Peruggi, Glastonbury, Conn.; David W. Barrett, East Hartland, Conn.

[73] Assignee: Otis Elevator Company, Farmington, Conn.

[21] Appl. No.: 1,728

[22] Filed: Dec. 31, 1997

[51] Int. Cl.[6] ..... B66B 13/14; B66B 13/02

[52] U.S. Cl. ..... 187/316; 187/331

[58] Field of Search ..... 187/316, 317, 187/331, 313; 49/90.1, 116, 118

[56] References Cited

U.S. PATENT DOCUMENTS

| | | | |
|---|---|---|---|
| 4,188,552 | 2/1980 | Brimer | 310/13 |
| 4,501,090 | 2/1985 | Youshida et al. | 49/264 |
| 4,529,065 | 7/1985 | Kraft | 187/314 |
| 5,671,829 | 9/1997 | Rivera | 188/171 |

*Primary Examiner*—Robert E. Nappi

[57] ABSTRACT

When an elevator is running, the car door 27 is locked in the closed position by a brake shoe 12 which engages the edge of the door hanger 24 in response to a push-type solenoid 19 overcoming the force of a spring. When the door is not closed, a friction brake pad 11 contacts the door hanger surface to hold the door open for passenger boarding or to stop the door in case of failure of door operator power while the door is in motion.

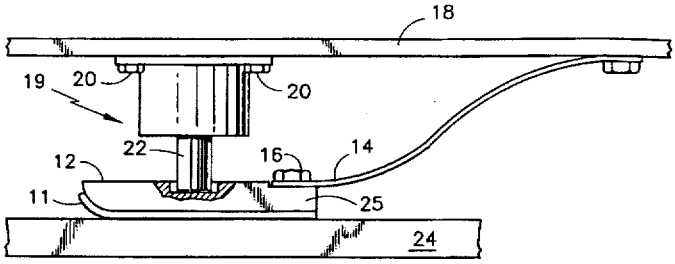

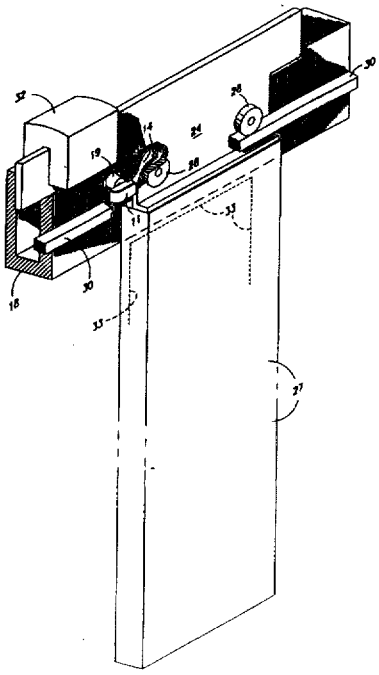

2 Claims, 2 Drawing Sheets